United States Patent [19]

Kinney et al.

[11] 3,975,138

[45] Aug. 17, 1976

[54] OIL BURNER

[76] Inventors: Leslie J. Kinney, 1010 Chillum Road, Chillum, Md. 20782; Edward M. Knapp, 951 N. Livingston St., Arlington, Va. 22205

[22] Filed: Aug. 29, 1974

[21] Appl. No.: 501,629

[52] U.S. Cl. ..... 431/161; 431/233; 431/242; 431/243; 431/247

[51] Int. Cl.[2] ..... F23D 11/44

[58] Field of Search ..... 431/233, 234, 235, 242, 431/243, 247, 207, 11, 161

[56] References Cited

UNITED STATES PATENTS

| | | | |
|---|---|---|---|
| 2,396,577 | 3/1946 | Kittel et al. | 431/242 |
| 2,460,451 | 2/1949 | Farrell | 431/243 |
| 2,988,887 | 6/1961 | Miluken | 431/247 |
| 3,409,076 | 11/1968 | Quiring | 431/242 |

*Primary Examiner*—Edward G. Favors
*Attorney, Agent, or Firm*—Ulle C. Linton

[57] ABSTRACT

This invention combines specific new and novel equipment with the equipment of a conventional combustion system for the use of liquid fuel oil to create a new system which converts the liquid fuel into gas and operates as a gas burner rather than as a liquid oil burner. The new and novel equipment thermally cracks liquid hydrocarbons into gaseous hydrocarbons which have substantially lower molecular weights than the liquids from which they were cracked. In the system the burner apparatus itself is modified to burn gas rather than liquid. In this new system the fuel burned does not consist of vapors of the liquids supplied to it but instead operates on the products of decomposition derived from the liquids.

4 Claims, 4 Drawing Figures

OIL BURNER

PRIOR ART

The prior art in liquid oil burners provides for the atomization of a thin stream of liquid into a cloud of droplets commingled with vapor. In the pesence of air supplied by a blower and means for ignition, typically in the oil burner for home use an electric arc, the droplets and vapor burn with moderate efficiency and the production of products of combustion containing unburned carbon, carbon monoxide, and unburned hydrocarbons. Air in excess of the stoichiometric is supplied to reduce this, but this is counterbalanced by some loss of efficiency. In the present invention the stream of liquid has been decomposed into gas, and this burns at high efficiency with an absolute minimum of excess air and with high efficiency. The products of combustion of the process in the new invention contain substantially nothing that is not fully combusted.

The object of the present invention is to create a system by which liquid fuels can be burned more efficiently by converting them to gas within the burner so that the combustion process can be more efficient. Thus a second object is to conserve fuel by getting more heat from the combustion of a given amount of fuel. A third object is the production of an oil burner which does not create products of combustion which pollute the atmosphere. These objects apply both to oil burners for home use and to burners used in industry.

The new and novel elements in the invention are: (1) A thermal cracker to change the chemical structure of liquid fuels into gaseous fuels (not vapors of the liquids) consisting of a hollow steel chamber positioned and supported within the combustion zone created by the burner system, said hollow steel chamber being divided into upper and lower sub-chambers by an incomplete steel septum permitting passage of gas between the sub-chambers, the lower sub-chamber being fitted with an inlet tube for liquid hydrocarbons or other liquid fuels, and the upper sub-chamber being fitted with an exit tube for the gas generated within the thermal cracker; (2) A gas delivery tube communicating from the thermal cracking chamber to a gas burner positioned so that it encircles a conventional liquid fuel nozzle immediately adjacent to the liquid fuel nozzle tip; (3) A structure to regulate the flow of liquid fuel during combustion, this structure containing a number of sub-units which will be described in detail subsequently in this specification.

The conventional elements of the oil burner, with which the new and novel equipment are combined, consist of the large tube extending toward the zone of combustion, the motor which drives both a blower for air and a fuel pressure pump, an adjustable shutter for modulation of the air supply, electrodes for the initiation and maintenance of combustion, and a transformer to provide appropriate electric current. No claim of patentable art is made for any of these elements since the invention resides in the new and novel equipment and in its combination with the conventional equipment.

The structure to regulate the flow of liquid fuel, part of the new and novel equipment, consists of the following sub-elements: (*a*) A junction, configured as a T in the liquid fuel line between the fuel pump and a conventional liquid fuel nozzle, so arranged that from the junction liquid can flow either to the conventional nozzle or to the thermal cracker, No. (1) above; (*b*) A liquid fuel line communicating between the aforesaid junction and the lower sub--chamber of the thermal cracker; (*c*) A second junction configured as a T positioned in the liquid fuel line between juction (*a*) and the thermal cracker; (*d*) A by-pass liquid fuel line between junction (*c*) and the upstream side of the fuel pump; (*e*) an adjusting valve set into by-pass liquid line (*d*), capable of modulating the amount of fuel returned via the by pass to the upstream side of the fuel pump and thus indirectly modulating the amount of liquid fuel passed to the thermal cracker; (*f*) A switch valve assembly, thermostatically controlled by the heat present in the cracking chamber and operating to switch the flow of liquid from the conventional liquid burner nozzle to the lower sub-chamber of the thermal cracker.

In the above recital of sub elements of the liquid flow control system, items (*a*) (*b*) (*c*) and (*d*) are structural items required to permit the operation of items (*e*) and (*f*), as follows: The pre-set adjustment of valve (*e*) permits the conventional fuel pump to deliver its normal volume and pressure, and this valve bleeds part of the volume and pressure back to the inlet side of the fuel pump. This takes account of the fact that by converting the liquid fuel to gas the same heat is delivered by the combustion of a smaller amount of that liquid. With respect of item (*f*) the presence of enough heat in the cracker to support the cracking operation actuates a solenoid which actuates two valves, closing one and opening the other simultaneously, one valve in the fuel line to the conventional nozzle, and the other in the line to the thermal cracker. The absence of sufficient heat in the cracking chamber reverses the action of the solenoid.

Two embodiments of the invention are involved, as follows: (1) For the conventional home heating type including the gun-barrel construction, all the new and novel art described above, including sub-elements of the flow control system, are combined with conventional art to create a new system; (2) For the industrial or power plant burner, the first two elements of the new and novel art are used, and the entire flow control system described as the third item is replaced with a preset valve in a simple liquid fuel line leading to the thermal cracker. The point will be further discussed in terms of operation later in the specification.

The embodiment of this invention for the home heating oil burner takes into account two facts, as follows: (1) the operation of this burner is an on and off cycle, governed by the thermostat located in the living guarters of the home, providing automatic control which is remote; (2) the liquid fuel oil used is a light grade, and in operation creates only a moderate amount of pollution. Therefore, in each burning cycle under the new invention, the burner is started with the conventional combustion system of atomized droplets and vapors of the liquid fuel, ignited in a stream of air by conventional arc electrodes. The combustion heats the cracking chamber. When the thermostatic control in the cracker indicates the presence of sufficient heat in the cracker, as indicated by temperature, the switch valve assembly shuts off the flow of liquid to the conventional nozzle and diverts the flow of liquid to the combination of fuel line to the thermal cracker and by-pass relief line which has been described. No description of the thermostatic control has been provided here since it would be conventional art. One of several configurations for it would be a high temperature thermocouple, activating a solenoid through a relay.

Since the combustion of the gas generated in the thermal cracker of this invention is more efficient than the combustion of a mixture of droplets and vapor, less liquid oil is needed by the cracker to generate the amount of gas required to maintain combustion at a level which will provide proper heat for the home in which the invention is used. The by-pass relief line and associated equipment operates to control the flow of liquid to the proper amount. At such times as the temperature in the thermal cracker drops below a value required to maintain the cracking process the set of switch valves reverts to its cold mode to repeat the cycle which has been described. During combustion in the burner this will not occur, but during the off part of the on/off cycle it may or may not occur. The control system is designed to cope with this situation.

The embodiment for the industrial or power plant burner takes into account two facts, as follows: (1) such burners use a heavy and smoky fuel oil; (2) the operation of such a burner, once started, is continuous over a long period of time, without any cycle of on/off operation, actuated by an automatic thermostatic control. Because of the heavy fuel oil it is not desirable to initiate combustion with that oil because the period while the standard or conventional combustion is heating the thermal cracker would produce substantial pollution. Thus the cracker is heated with a torch fired by a light fuel oil or by gas. Fuel is never supplied to the conventional burner nozzle but is instead delivered to the thermal cracker and to the by-pass relief line with its preset relief valve to control the amount of fuel reaching the cracker. The switch assembly between the line to the conventional nozzle and the cracker is eliminated.

Having thus described the new and novel elements of the invention, and placed them in the two embodiments, neither of which is preferred since they serve different applications under different conditions, we present the invention through drawings specific to the home heating oil burner, and show the new and novel elements as they are intertwined with the conventonal art. Included in the explanation of the drawings is an indication as to whether the element shown is new and novel or conventional.

Figure 1:
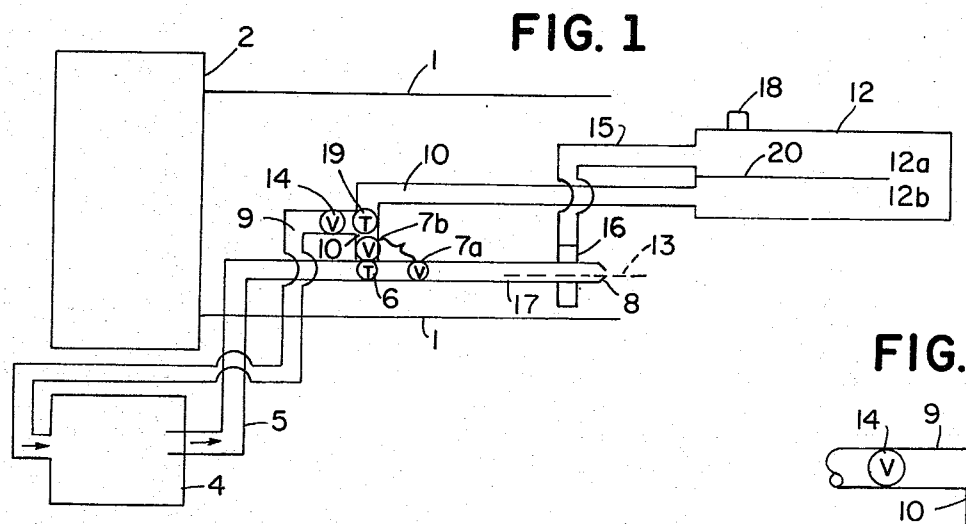
FIG. 1 shows the oil burner in cross section from the side.

In FIG. 1, reference 1 is the conventional gun barrel of the oil burner as mounted in the house furnace and extending into a conventional fire box, not shown. Conventional blower 2 drives air through barrel 1 to be mixed with liquid fuel and the miture combusted in the fire box beyond the end of the barrel. Conventional fuel pump 4 drives liquid fuelthrough conventional fuel line 5 and both blower 2 and pump 4 are driven by conventional motor 3, not shown in FIG. 1. Liquid fuel passes through junction 6, which is configured as a T, and subsequently may move in either of two directions as will be described as part of the invention.

During initial operation liquid fuel flows from junction 6 through conventional fuel line 17, to be atomized in conventional nozzle 8 and sprayed into the air stream entering the fire box where it is ignited by conventional electrodes 13. At this time, new and novel thermal cracker 12 is free of liquid and is heated by being positioned in the zone of combustion. Subsequently, the thermostatic control 18 indicates temperature sufficient to maintain a cracking operation and actuates switch valve assembly and interlock 21 to simultaneously close valve 7*a* and open valve 7*b*, diverting liquid fuel from conventional fuel line 17 to new and novel fuel line 10, which carries in it a second T junction 19. Line 10 continues on to the lower subchamber of thermal cracker 12, while at the same time new and novel by-pass relief fuel line 9 leads from junction 19 in fuel line 10 to the inlet side of pump 4.

Mounted in new and novel fuel line 9 is a throttle valve 14, which is preset to partition the flow of liquid fuel from junction 6 as between lines 9 and 10. Control of the amount returned to the pump 4 controls the amount delivered to the thermal cracker 12. At the same time the flow from pump 4 through line 5 is maintained at the proper volume, speed, and pressure, while the delivery of liquid fuel to the cracker is adjusted to the amount required to produce the proper amount of gas for combustion.

Gas is generated in the lower sub-chamber of thermal cracker 12, from which point it passes around or through incomplete septum 20 into the upper subchamber and from there it flows through gas line 15 to burner head 16 surrounding and adjacent to conventional liquid nozzle 8, and discharged from there into the fire box it is ignited by conventional electrodes 13. The zone of combustion continues to keep the thermal cracker at a high temperature. If at any time, particularly during the off portion of the on/off cycle of such a burner, the temperature within the thermal cracker drops below a predetermined point, the thermostatic control 18 and the interlocking switch valve assembly 21 closes valve 7*b* and opens valve 7*a* to repeat the heating cycle, either during combustion or at the beginning of a new period of combustion.

Figure 2:
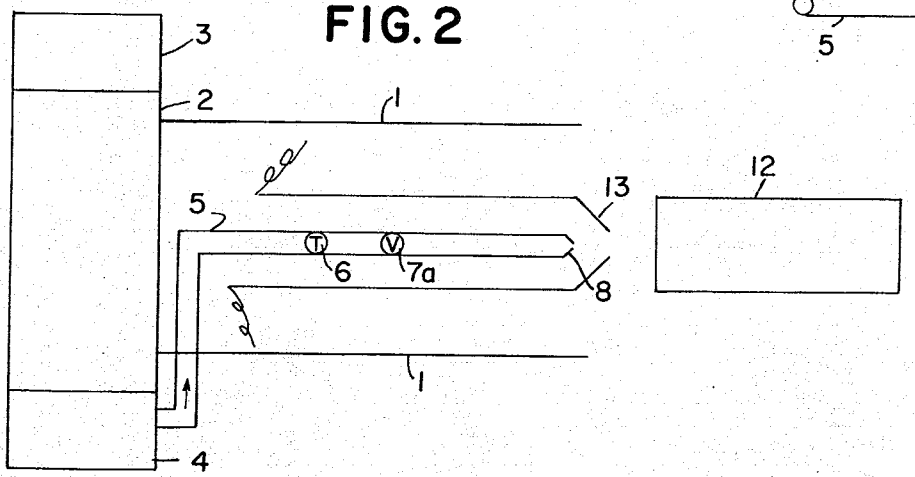
FIG. 2 shows the oil burner in cross section from above.

In FIG. 2, barrel 1 is supplied with air by fan 2, and with liquid fuel by pump 4, both driven by motor 3. Liquid fuel flows through line 5 to junction 6. From junction 6 the liquid fuel takes two alternative routes, the first containing line 17, valve 7*a*, and nozzle 8, and the second containing line 10 and valve 7*b*, there being a second alternative route, either line 10, continuing or the combination of line 9 and valve 14. Of these second alternatives one ends in thermal cracker 12 and the other at the inlet side of pump 4. Thermal cracker, shown only by its outer shell lies beyond electrodes 13.

Figure 3:
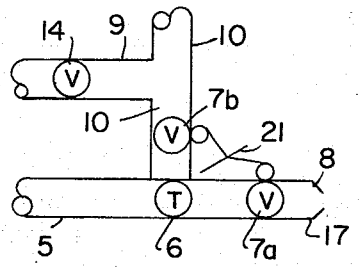
FIG. 3 shows the detail of the switch valve assembly.

In FIg. 3, liquid fuel arrives via line 5, and passes through junction 6, and thereafter through line 17, valve 7*a*, and nozzle 8 or through line 10, with its by-pass of line 10, and valve 14. Valves 7*a* and 7*b* are actuated by interlock 21, shown only symbolically.

Figure 4:
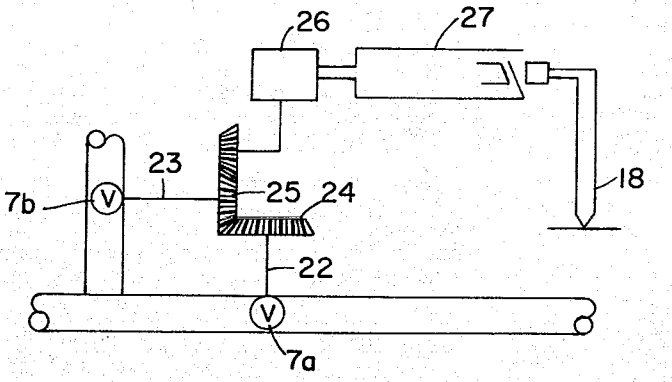
FIG. 4 shows the details of the interlocking valves, reference character 21 on FIG. 3.

In FIG. 4, valves 7*a* and 7*b* are interconnected through shafts 22 and 23, on which are mounted bevel gears 24 and 25, the gears being driven by solenoid device 26 on which neither the detail nor the connection to drive the gears are shown. Thermostatic device 18, mounted on the outside of thermal cracker chamber 12, generates the current to actuate the relay 27, which in turn actuates the solenoid 26, the motion being transmitted to the gears to operate the valves.

Embodiment of the invention 2 requires no separate drawing since it is identical with embodiment 1 with the omission of fuel line 17, valve *7a*, and nozzle 8. The torch for ignition is conventional art and need not be shown.

Having thus described the invention, We claim:

1. In a furnace having an oil burner, an apparatus for the thermal cracking of liquid hydrocarbons into gaseous hydrocarbons and for the delivery of said gaseous hydrocarbons to a gas burner, and for the structure of valves required to control the flow of liquid fuel to the aforesaid thermal cracking, comprising in combination a hollow steel chamber positioned in the zone of combustion created in the furnace by the burning of either oil or gas, said hollow steel chamber being divided by a partial septum configured laterally to divide the hollow steel chamber into upper and lower sub-chambers with gas able to flow from the lower sub-chamber to the upper sub-chamber, the lower sub-chamber being fitted with an inlet for the entrance of liquid fuel and the upper sub-chamber fitted with an outlet for the gas produced in the hollow steel chamber, a thermostatic device being fitted in said hollow steel chamber, the apparatus further comprising a gas delivery tube communicating between said outlet from the upper sub-chamber and a standard gas burner head encircling and adjacent to the liquid burner nozzle of the furnace.

2. In a furnace having an oil burner, said burner being defined as having a tubular air passage, a powered blower to create a stream of air through the passage, a powered fuel pump and delivery tube to inject into the air stream atomized liquid fuel, and electrodes for the spark ignition of the mixture of oil and air, apparatus pursuant to claim 2 for the control of the flow of liquid fuel, comprising a junction in the configuration of a T placed in the liquid fuel delivery tube of said oil burner, with two separate delivery tubes exiting from aforesaid T junction, the first delivery tube leading to the conventional liquid fuel burner nozzle, and the second delivery tube leading to said hollow steel chamber said second delivery tube having mounted in it a second junction in the configuration of a T, said second junction having two tubes leading therefrom, the first tube of which continues on to the lower sub-chamber of said hollow steel chamber and the second of which tubes leads back to the input side of the fuel pump included in the oil burner, an adjustable valve fitted into the tube leading from the second junction to the input side of said fuel pump, said valve proportioning the flow between the thermal cracker and the input side of said fuel pump.

3. Apparatus in accordance with claim 2, including valves in each of said tubes leading from the first junction, namely those to said liquid fuel nozzle and to the thermal cracker said valves being interconnected for simultaneous action the one to close and the other to open, a solenoid device for actuating said valves, a spring loaded relay for actuating said solenoid, a thermostatic device mounted in said thermal cracker for actuating said relay.

4. In a furnace having an oil and a gas burner, apparatus for the thermal cracking of liquid hydrocarbons into gaseous hydrocarbons and for the delivery of said gaseous hydrocarbons to said gas burner and for the valves to control the flow of liquid fuel to the aforesaid thermal cracking comprising a hollow steel chamber positioned in the zone of combustion of said oil and gas burner, said hollow steel chamber divided laterally by a perforated septum into upper and lower sub-chambers, the upper sub-chamber fitted with an outlet for gas, and the lower sub-chamber being fitted with an inlet for liquid fuel, a thermostatic device, valves actuated by said thermostatic device, there being a gas delivery tube communicating between sid upper sub-chamber and said gas burner, and the liquid fuel delivery line being fitted with a single junction in the configuration of a T, with two tubes continuing beyond said junction, the first going to the lower sub-chamber of the hollow steel chamber, and the second tube going to the inlet side of the liquid fuel pump and an adjustable valve in said second tube leading to the inlet side of the fuel pump to proportion the amount of fuel flowing to the inlet side of the fuel pump against the amount flowing to the thermal cracking apparatus.

* * * * *